United States Patent [19]

Farina et al.

[11] 4,423,576

[45] Jan. 3, 1984

[54] BUILDING STRUCTURE AND COMPONENT THEREFOR

[75] Inventors: Joseph Farina, East Orange; Antonio Pacelli, West Paterson, both of N.J.

[73] Assignee: Titan Marble & Stone Co., Totowa, N.J.

[21] Appl. No.: 213,058

[22] Filed: Dec. 4, 1980

[51] Int. Cl.[2] ..... E04B 1/24

[52] U.S. Cl. ..... 52/235; 52/263; 52/513

[58] Field of Search ..... 52/474, 483, 585, 694, 52/612, 408, 410, 235, 263, 513

[56] References Cited

U.S. PATENT DOCUMENTS

| | | | |
|---|---|---|---|
| 1,732,190 | 10/1929 | Daman | 52/408 |
| 1,768,626 | 7/1930 | Pedersen | 52/408 |
| 2,020,908 | 11/1935 | Scammell | 52/347 |
| 2,178,097 | 10/1939 | Davison et al. | 52/474 |
| 2,333,600 | 11/1943 | Trautvetter | 52/663 |
| 2,338,468 | 1/1944 | Tench | 52/793 |
| 2,724,465 | 11/1955 | Krauss et al. | 52/407 |
| 4,030,256 | 6/1977 | Ollman | 52/694 |
| 4,037,381 | 7/1977 | Charles | 52/612 |
| 4,045,933 | 9/1977 | Grillo | 52/513 |
| 4,110,053 | 8/1978 | Buchholz | 52/585 |

*Primary Examiner*—James L. Ridgill, Jr.
*Attorney, Agent, or Firm*—Siegmar Silber

[57] ABSTRACT

A prefabricated facing panel for affixation to building framework having load-bearing columns is disclosed which panel is formed from a frame of structural steel members, usually a truss, an interconnection device and a plurality of facing members such as facing stone generally marble, granite, limestone or travertine. The prefabricated panel is dimensioned to extend between adjacent columns of said building framework. The facing members have blind holes in the back thereof being in alignment with the apertures of interconnector device providing a highly wind resistant mounting. The weight of said facing members is transmitted through the frame to the columns of the building framework.

8 Claims, 7 Drawing Figures

BUILDING STRUCTURE AND COMPONENT THEREFOR

BACKGROUND OF INVENTION

1. Field of the Invention

This invention relates to the construction of buildings, and more particularly to the prefabrication of building components which comprise building wall units therefor. The building components are typically structure steel truss with building stone slabs affixed to one side thereof. These structures are prefabricated for attachment to the columns of the building. The prefabricated structures enable the constructor to adopt a method of building erection that is extremely efficient and yields high-strength buildings capable of withstanding substantial stresses.

2. Description of the Prior Art

In the past, stone facing was customarily installed by stonemasons at the building site first erecting supporting walls and then adhering the facing material thereto. These walls rested upon the horizontal structural steel members or spandrels and, upon the facing materials being added thereto, represented considerable loading on the spandrels. In the 1950's and 1960's as stonemasons became scarcer and the economics of supply and demand drove the price upward, the older system just described became somewhat cost ineffective. At approximtely the same time the steel, skeleton-frame construction was adapted to accommodate curtain walls which are supported at each floor by steel spandrel beams which, in turn, are supported by the exterior columns. This construction allows walls of uniform thickness throughout the height of the building and avoids excessively thick walls formed in wall-bearing construction. To date, this was the accepted manner of building skyscrapers and using glass, ceramic and light-gage metal walls. Additionally, for one reason or another, new high-rise buildings with such curtain walls were being erected and wind resistance of the sheating became problematic. Thus, demand grew for prefabricated units which are cost effective, readily assembled at the site, and which met wind resistance and other building code criteria.

Just prior to and during the same period some technical developments occurred, but the technical and patent literature remains somewhat sparse. In preparation for this application a novelty search was conducted which uncovered J. L. Trench, U.S. Pat. No. 2,338,468; W. W. Krauss et al, U.S. Pat. No. 2,724,465; and, J. R. Grillo, U.S. Pat. No. 4,045,933. The field of search for this novelty search was Class 52, subclasses 235, 274, 477, 483, 506, 511, 513, 580, 601, 619, 620, 621, 622, 623, 793, and 813. The patent to Tench (hereinafter Tench '468) shows a channeled girder or truss being adapted for bridge decking.

SUMMARY OF THE INVENTION

In the disclosure herein, several parallel truss structures of parallel chord type, including Pratt, Howe and Warren trusses and compound forms thereof optionally utilizing Vierendeel truss portions are used as subcomponents of the invention. The term truss as used within this specification is used in the broad sense to encompass the structural steel subassembly having moment-resisting joints and, at least, when assembled to the building vertical primary web members at each and thereof which together with the chords shift the load of the wall material to the columns of the building.

A prefabricated facing panel for affixation to building framework having load-bearing colums is disclosed which panel is formed from a frame of structural steel members, usually a truss, an interconnection device and a plurality of facing members such as facing stone generally marble, granite, limestone or travertine. The prefabricated panel is dimensioned to extend between adjacent columns of said building framework. The facing members have bline holes in the back thereof being in alignment with the apertures of interconnector device providing a highly wind resistant mounting. The weight of said facing members is transmitted through the frame to the columns of the building framework.

It is an object of the present invention to provide for effecient mounting of facing stones by forming a prefabricated panel with the stones mounted thereon.

It is a further object of the invention to provide a prefabricated panel with a truss or truss-like backing which spans between adjacent building columns of a building framework.

It is an additiional object of the invention to provide a family of prefabricated panel examples which may be used as design components in building construction.

It is a further objection of the invention to provide a highly wind and force resistant construction.

It is a yet further object of the invention to provide a prefabricated panel which is easily installed to the building columns.

The novel features which are believed to be characteristic of the invention, both as to organization and method of operation, together with further objects and advantages thereof will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENTS

In the essential concept of the invention, structural steel members are formed into the truss assembly to which is attached to one or more pieces of the facing medium, usually marble, granite, limestone or travertine facing stones. Any other flat-backed rigid material may be used, including, but not limited to, other naturally occurring building stone; aggregates; molded decorative panels of reinforced concrete, plastics, and ceramics; cast metal, cast stone or cast concrete; and architectural block, tile or porcelain enamel constructions. In the material of the preferred embodiment, namely naturally occurring stone, anchors are set into the back of the stone by the procedure described hereinbelow. The stone facing medium and the truss assembly are married together to form a prefabricated building panel which, in turn, can be attached to the columns of the building structure. The truss is dimensioned so as to extend from column to column. With this arrangement, no bearing load is exerted upon the spandrel beams. This enables the structural designer to freed from the constraints of past prefabricated panel designs and to use the columns and truss/facing medium combinations as adding to the structural framework rather than merely adding a load factor.

Figure 1:
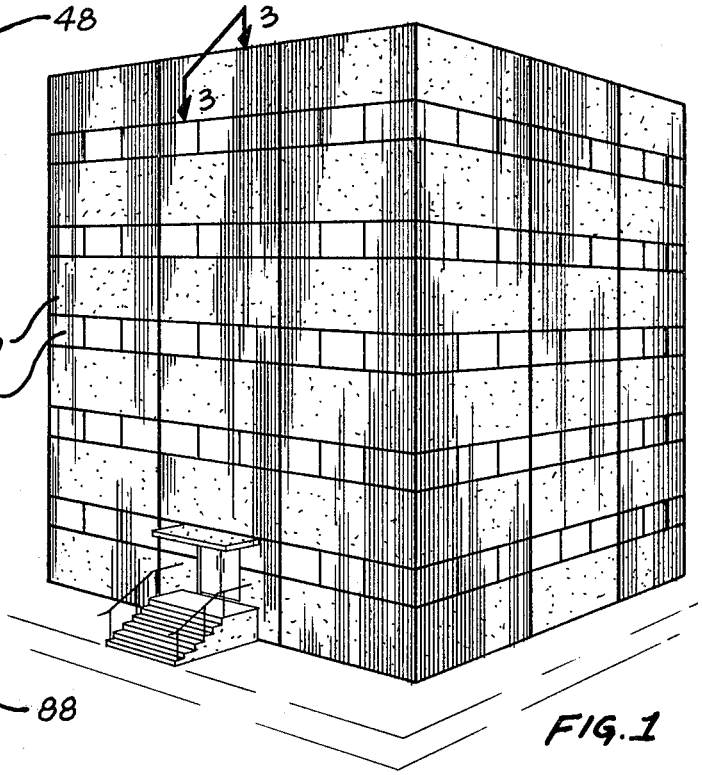
FIG. 1 is a perspective view of a multistory structure having prefabricated panels according to the present invention attached to the surface thereof.

Referring now to FIG. 1, there is shown a multistoried building of the type to which prefabricated truss/-facing medium combinations of the present invention are presently applicable. Such structures comprise the usual columns C, structural steel spandrel beams B and concrete floors F.

Figure 6:
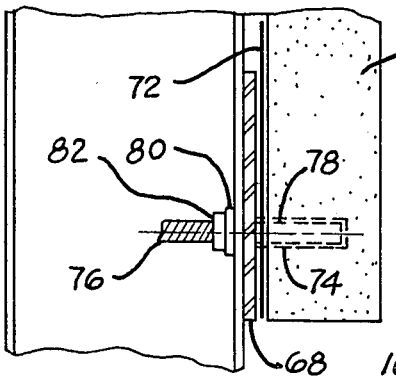
FIG. 6 is a detail view of the connection means between the truss structure and the facing medium.

Referring now to FIGS. 2 through 6 the details of the preferred embodiment are shown. The prefabricated panel assembly was generally referred to as reference designator 10. The assembly is constructed from a truss arrangement best illustrated in FIG. 2 having parallel chord members 12 and 14 and vertical end pieces 16 and 18. Diagonal web members 20, 22, 24, 26 and 28 are provided to distribute the forces incurred by the weight of the building facing medium. In the illustration shown the unit is a modified Pratt truss wherein the diagonal web members are basically in tension. Vertical web members 30, 32, 34 and 36 are also provided. All the truss members are constructed from structural steel components that are readily commercially available. Vertical end pieces 38, 40, 42 and 44 provide for column engagement of the prefabricated panel (the details thereof are shown more clearly in FIG. 4) to the truss assembly the facing media, in the preferred embodiment marble is connected. The marble of the preferred embodiment is cut so as to span between adjacent vertical members of the truss assembly. Marble pieces 48, 50, 52, 54 and 56 occupy the upper part of the truss shown and marble pieces 58, 60, 62, 64 and 66 occupy the lower portion of the truss assembly and the marble there is provided a series of tabs 68 welded to the face of one side of the truss. These tabs are selected to be of the same thickness as the steel weldments 70 so as to provide a substantially flat coplanar support for the marble facing material. The tabs 68 are apertured so as to accommodate fastening assemblies for the connection of the marble and the truss. Referring now to FIG. 6, the details of the connection between the truss and the marble stone pieces are shown. In the present invention, the stones are first arrayed on a work table and the vapor barrier material 72, in the preferred embodiment 10-mil. Nervastral barrier flashing material is laid over the rear of the marble stone pieces as to form a continuous web thereover. The truss assembly is mounted thereon and blind holes 74 are formed in the back of the marble at locations corresponding to the apartures of tabs 68. Threaded studs 76 are then set in an epoxy or cementitious adhesive 78 in a manner that the stud portion extends beyond the tabs. An energy absorbing washer 80 and a threaded nut 82 are mounted on the threaded stud to secure the marble and the truss in the manner required. The mounting arrangement just described is structured to provide a highly wind-resistant arrangement.

Figure 4:
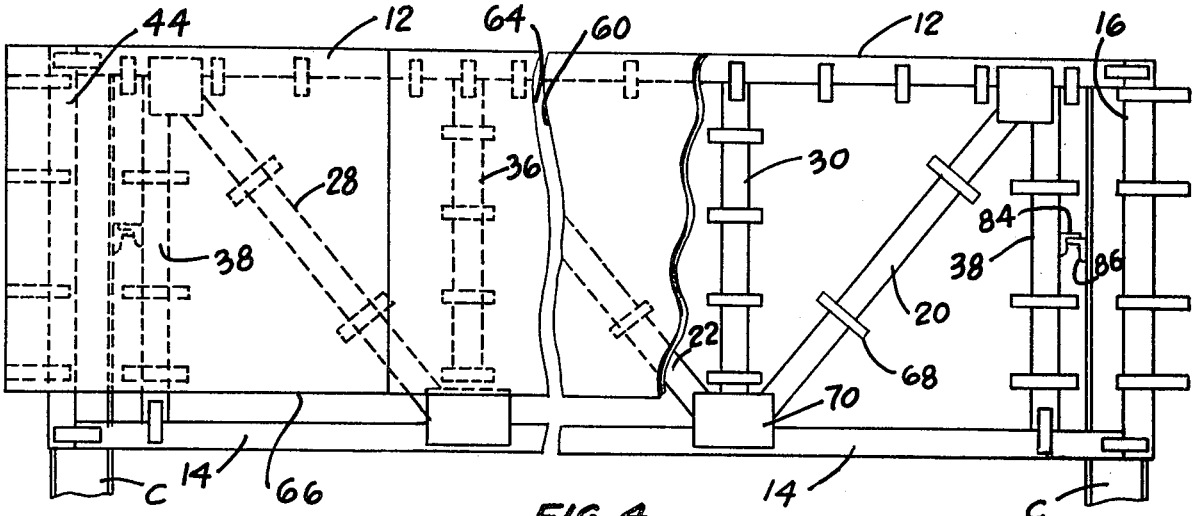
FIG. 4 is a plan view of the installed panels of this invention showing a portion of the facing medium broken away so as to illustrate the connection to the building columns of the panel.
Figure 5:
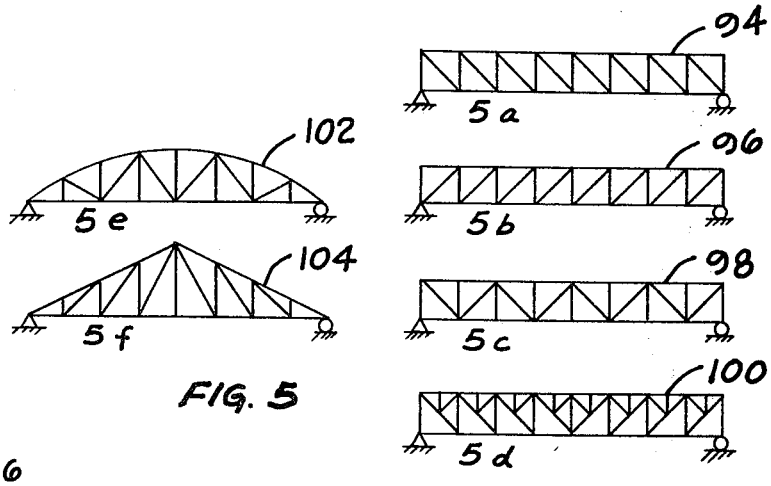
FIG. 5 is a series of detail views of various truss structures which are utilized in the structure of the invention.
Figure 2:
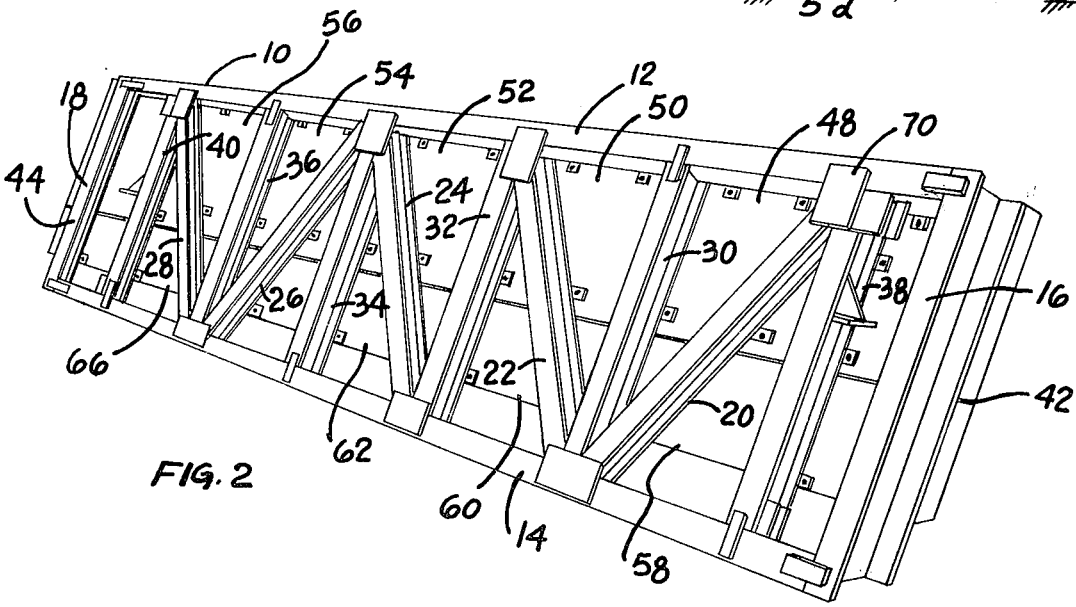
FIG. 2 is a perspective view looking from the rear of the structure of the invention.

In FIG. 4 the details of mounting the prefabricated panel and the relationship the building colums are shown. Brackets 84 mounted upon vertical member 38 is structured for connection to bracket 86 mounted upon column C of the building. Other points of attachment, which are similar to connected brackets 84 and 86, further enhance the wind-resistant characteristic of the structure.

Figure 3:
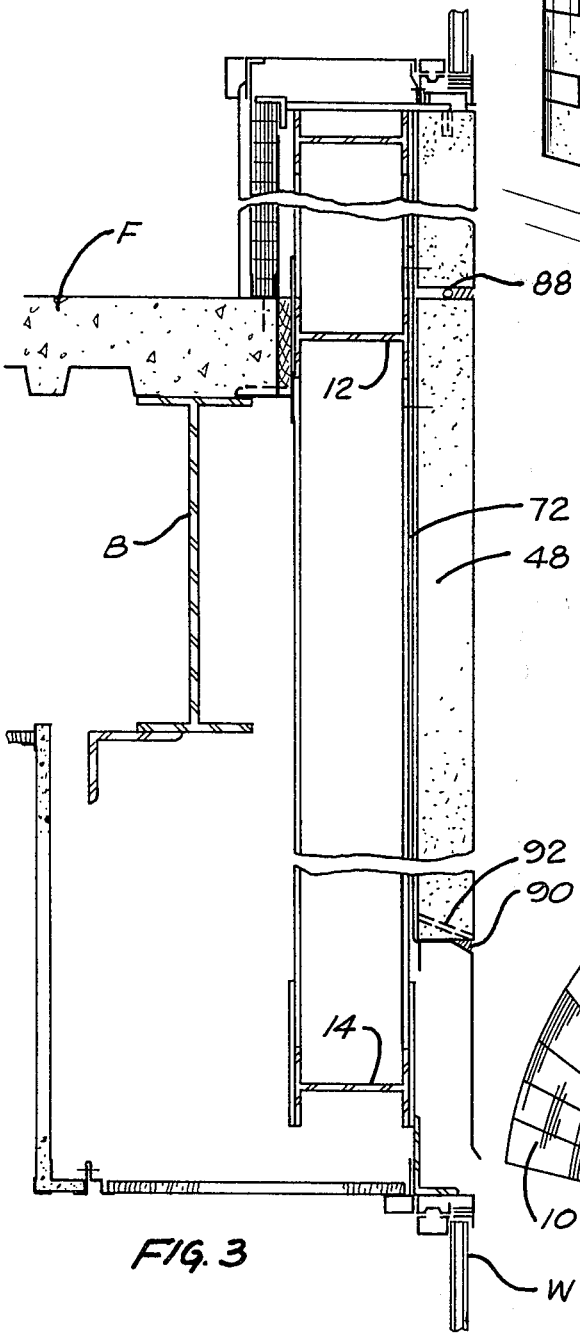
FIG. 3 is a cross sectional diagram of a structure in FIG. 1 taken along line 3—3.

The installation is also thoroughly rain- and moisture-resistant being provided with sealant as shown in FIG. 3. Beads of sealant 88 and 90, preferably polyurethane-based, 2-part elastomeric sealant is employed. Sealant is applied between adjacent marble pieces and between the marble and the window assemblies.W. Weep holes 92, shown adjacent sealant 90, is provided for the release of condensate entrapped by vapor barrier 72.

FIGS. 5*a*, 5*b*, 5*c*, 5*d*, 5*e* and 5*f* show a variety of truss forms which may be utilized with the prefabricated panel of this invention. Shown by way of example are Pratt truss 94, Howe truss 96, Warren truss 98, and the subdivided truss 100, all of which trusses are of the parallel chord classification. Also of interest for this purpose are the bowstring truss 102 and the Pratt truss, sloping chord truss 104 which are adaptable to fitting the disclosed invention to various rooflines.

Figure 7A:
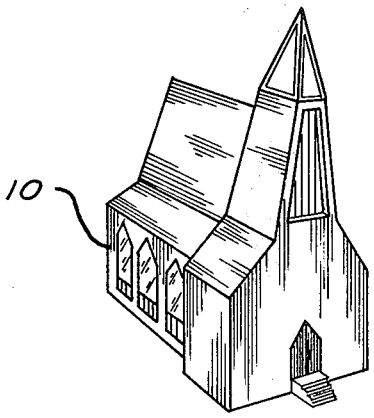
FIG. 7 is a perspective view of a building designed to be constructed substantially from columns and the prefabricated panels of this invention.
Figure 7B:
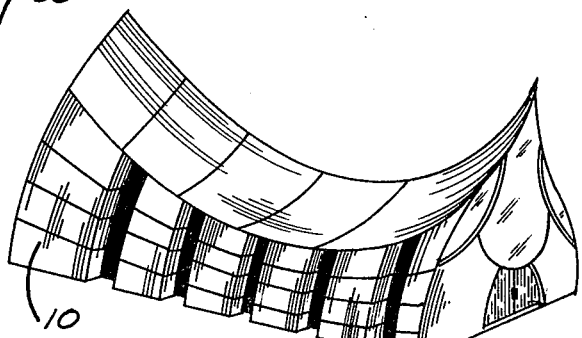

FIGS. 7*a* and 7*b* demonstrate the flexibility of design in working with buildings wherein the prefabricated panels and columns may be used to construct almost the entire outer shell of the bilding.

While an attempt has been made to illustrate fully the desired item, slight adaptations are feasible while remaining within the spirit and scope of the present invention, as propounded by the following claims.

We claim:

1. A prefabricated facing panel for a building comprising, in combination:

(a) a building framework with vertical columns;

(b) a frame of structural steel members having at least an upper cord member and a lower chord member with a plurality of web members interconnecting said upper chord member and said lower cord member, said frame secured to and dimensioned to extend between adjacent vertical columns of said building framework;

(c) tab means for mounting facing media, each said tab means attached at one face thereof to one side of said frame, with each opposite face thereof being in substantial planar alignment with corresponding faces of remaining tab means, said tab means having apertured portions extending beyond said structural steel members for accommodating connectors;

(d) a plurality of facing members having an exposed front and a back, the back of said facing member being adjacent the substantially coplanar faces of said tab means, said facing members having blind holes in the back thereof being in alignment with the apertures of said apertured portions of said tab means, and;

(e) a plurality of connector means for connecting said facing members and said tab means, each said connector means adhered to one end thereof to said blind hole, extending therefrom through said apertures of said tab means and secured at the other end thereof to said tab means;

whereby the weight of said facing members is transmitted through said frame to said vertical columns of said building framework.

2. A prefabricated facing panel as described in claim 1 wherein said frame of structural steel members is a direct welded construction.

3. A prefabricated facing panel as described in claim 1 wherein said frame of structural steel members is a truss.

4. A prefabricated facing panel as described in claim 1 wherein said frame of structural steel members is a Howe truss.

5. A prefabricated facing panel as described in claim 1 wherein said frame of structural steel members is a Warren truss.

6. A prefabricated facing panel as described in claim 1 wherein said frame of structural steel members is a complex truss formed therefrom.

7. A prefabricated facing panel as described in claim 1, wherein said panel further comprises a moisture barrier means for precluding from said frame moisture penetrating behind said facing member, said moisture barrier means being held in place between said tab means and said back of said facing member.

8. A prefabricated panel means as described in claim 7 wherein said moisture barrier means is of plastic sheeting material.

* * * * *